US007120367B2

(12) United States Patent
Kyung et al.

(10) Patent No.: US 7,120,367 B2
(45) Date of Patent: Oct. 10, 2006

(54) METHOD OF CONTROLLING A TRANSFER VOLTAGE FOR AN IMAGE FORMING APPARATUS

(75) Inventors: Myung-ho Kyung, Suwon-si (KR); Kyung-hwan Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 55 days.

(21) Appl. No.: 10/975,498

(22) Filed: Oct. 29, 2004

(65) Prior Publication Data

US 2005/0095023 A1 May 5, 2005

(30) Foreign Application Priority Data

Oct. 31, 2003 (KR) ..... 10-2003-0076575

(51) Int. Cl.
*G03G 15/00* (2006.01)
*G03G 15/16* (2006.01)

(52) U.S. Cl. ..... 399/44; 399/66

(58) Field of Classification Search ..... 399/44, 399/45, 46, 66, 91–92, 94, 97, 389
See application file for complete search history.

(56) References Cited

U.S. PATENT DOCUMENTS 6,192,203 B1 * 2/2001 Nishio et al. ..... 399/44
6,389,241 B1 * 5/2002 Cernusak et al. ..... 399/44
6,829,444 B1 * 12/2004 Ashikawa ..... 399/44

FOREIGN PATENT DOCUMENTS

| | | |
|---|---|---|
| JP | 08-006430 | 1/1996 |
| JP | 11-038861 | 2/1999 |
| JP | 2001-318575 | 11/2001 |
| KR | 1996-8887 | 3/1996 |

OTHER PUBLICATIONS

Korean Official Action issued on Aug. 23, 2005, for Korean Patent Application No.: 2003-76575 (listing 1 reference).

* cited by examiner

*Primary Examiner*—Hoang Ngo
(74) *Attorney, Agent, or Firm*—Stanzione & Kim, LLP

(57) ABSTRACT

A method of controlling a transfer voltage of an image forming apparatus includes sensing an external temperature of the image forming apparatus, sensing an internal temperature of the image forming apparatus, determining a transfer voltage to be applied to a transfer roller according to the sensed external and internal temperatures, and applying the determined transfer voltage to the transfer roller. The method enables the image forming apparatus to improve a printing quality.

20 Claims, 5 Drawing Sheets

METHOD OF CONTROLLING A TRANSFER VOLTAGE FOR AN IMAGE FORMING APPARATUS

CROSS-REFERENCE TO RELATED APPLICATIONS

This application claims benefit under 35 U.S.C. § 119 from Korean Patent Application No. 2003-76575, filed on Oct. 31, 2003, the entire content of which is incorporated herein by reference.

BACKGROUND OF THE INVENTION

1. Field of the Invention

The present general inventive concept relates to a method of controlling a transfer voltage for an image forming apparatus, and more particularly, to a method of controlling a transfer voltage using an ambient temperature sensed by a temperature sensor.

2. Description of the Related Art

In general, image-forming apparatuses may include laser beam printers, a LED printer head (LPH) printers, facsimile machines, and so on. The image-forming apparatuses perform a print operation through charge distribution, exposure, development, transfer and fusing processes.

FIG. 1 is a view illustrating a general image forming apparatus. Referring to FIG. 1, the image forming apparatus includes a photosensitive drum 10, an optical scanning unit 12, a developing unit 13, a transfer unit 20 having a transfer belt 14, a transfer roller 21, a fuser roller 22, and so on.

The photosensitive drum 10 is also called an Organic Photo-Conductive (OPC) drum. The photosensitive drum 10 is a part on which an image is formed using light before the image is printed on a printing paper P, and its surface is charged with a uniform high voltage by a charge roller (not illustrated).

The optical scanning unit 12 is also called a laser scanning unit (LSU), and forms a latent image on the surface of the photosensitive drum 10 by outputting the light corresponding to the image on the rotating photosensitive drum 10. The latent image formed on the surface of the photosensitive drum 10 by the optical scanning unit 12 is called an electrostatic latent image.

The developing unit 13 converts the electrostatic latent image on the surface of the photosensitive drum 10 into a visible image using toner particles. In a case of a color image forming apparatus, the developing unit 13 is provided with toners of colors, such as yellow, magenta, cyan and black, and mixes the toners of the respective colors in the order of yellow, magenta, cyan and then black to enable a desired color to be printed.

The converted visible toner image is transferred to the transfer belt 14 by a photosensitive transfer roller 16. The transfer belt 14 is driven and rotated along an endless track by a driving roller 19 and a plurality of rollers installed on a path of the endless track. The plurality of rollers include a backup support roller 15 that is rotated as the driving roller 19 is rotated, a nip roller 17 and a tension roller 18 for adjusting tension of the transfer belt 14. Also, the transfer roller 21 is in contact with one side of the transfer belt 14.

A high-voltage terminal 24 is connected to the transfer roller 21. By a high voltage applied from the high-voltage terminal 24, the transfer roller 21 moves the visible toner image transferred to the transfer belt 14 to a front surface of the printing paper P. At this time, since the toner image moves to the front surface of the printing paper by a weak electrostatic force of the transfer roller 21, the toners may be scattered due to an external influence. Accordingly, the fuser roller 22 melts and firmly fuses the toner image to the printing paper P by applying heat and pressure to toner particles of the toner image that have moved to the printing paper.

According to the general image forming apparatus, however, a characteristic of the toner image fused on the printing paper P is changed according to a transfer voltage applied to the transfer roller 21. Specifically, if the transfer voltage is low, the toner image is not efficiently stuck on the printing paper P due to a weak electrostatic attraction force generated from the transfer roller 21, and an image trembling phenomenon occurs. By contrast, if the transfer voltage is high, the toner particles of the transfer belt 14 is inversely charged to make the toner image not stuck on the printing paper P, or the toner image is scattered before it is transferred to the printing paper P due to an electrostatic attraction force generated from the transfer roller 21.

Accordingly, it is necessary to properly adjust the transfer voltage in accordance with a resistance value of the printing paper that passes through the transfer roller, and a resistance value of the transfer roller. Especially, since the resistance value of the printing paper and the resistance value of the transfer roller are sensitive to an ambient temperature, the transfer voltage should be properly adjusted in accordance with the ambient temperature.

SUMMARY OF THE INVENTION

In order to solve the foregoing and/or other problems, it is an aspect of the present general inventive concept to provide a method of controlling a transfer voltage of an image forming apparatus in accordance with internal and external environments or conditions of the image forming apparatus.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a method of controlling a transfer voltage of an image forming apparatus, the method comprising sensing an external temperature of the image forming apparatus, sensing an internal temperature of the image forming apparatus, determining a transfer voltage to be applied to a transfer roller based on the sensed external and internal temperatures, and performing printing tasks by applying the determined transfer voltage to the transfer roller.

The determining of the transfer voltage may include calculating a difference between the sensed external and internal temperatures, and comparing the calculated temperature difference with a preset value. Accordingly, as a result of the comparison, if the internal temperature is higher than the external temperature by more than the preset value, the transfer voltage may be reduced by a predetermined value in the determining of the transfer voltage.

The method of controlling the transfer voltage may further include: measuring a resistance of the transfer roller and a resistance of a paper that passes through the transfer roller. Accordingly, the determining of the transfer voltage includes determining the transfer voltage according to the sensed external and internal temperatures, the measured resistance of the transfer roller and the measured resistance of the paper.

The image forming apparatus as constructed above can improve a print quality by properly adjusting the transfer voltage in accordance with the internal and external temperatures of the image forming apparatus.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
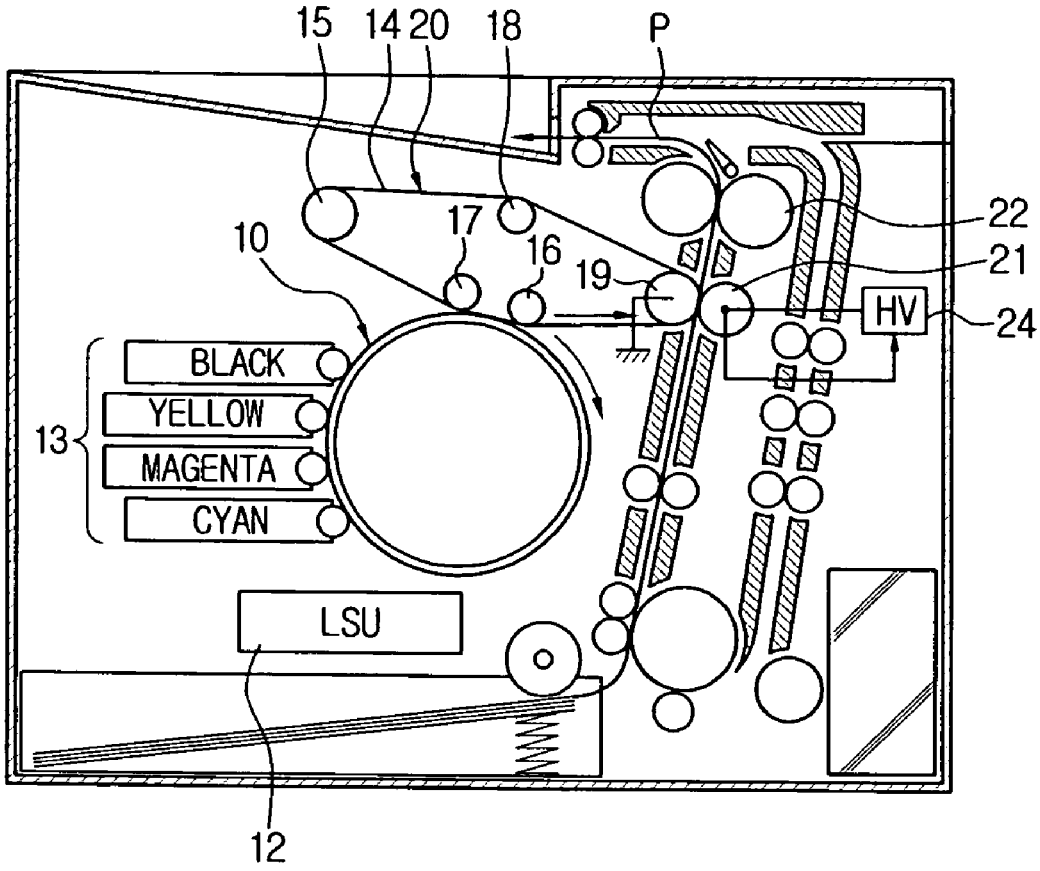
FIG. 1 (PRIOR ART)
FIG. 1 is a view illustrating a general image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

The matters defined in the description such as a detailed construction and elements are only the ones provided to assist in a comprehensive understanding of the invention, and should not limit the invention. Thus, it is apparent that embodiments of the present general inventive concept can be carried out without those defined matters. Also, descriptions of well-known functions or constructions are omitted for a better understanding of the general inventive concept.

Figure 2:
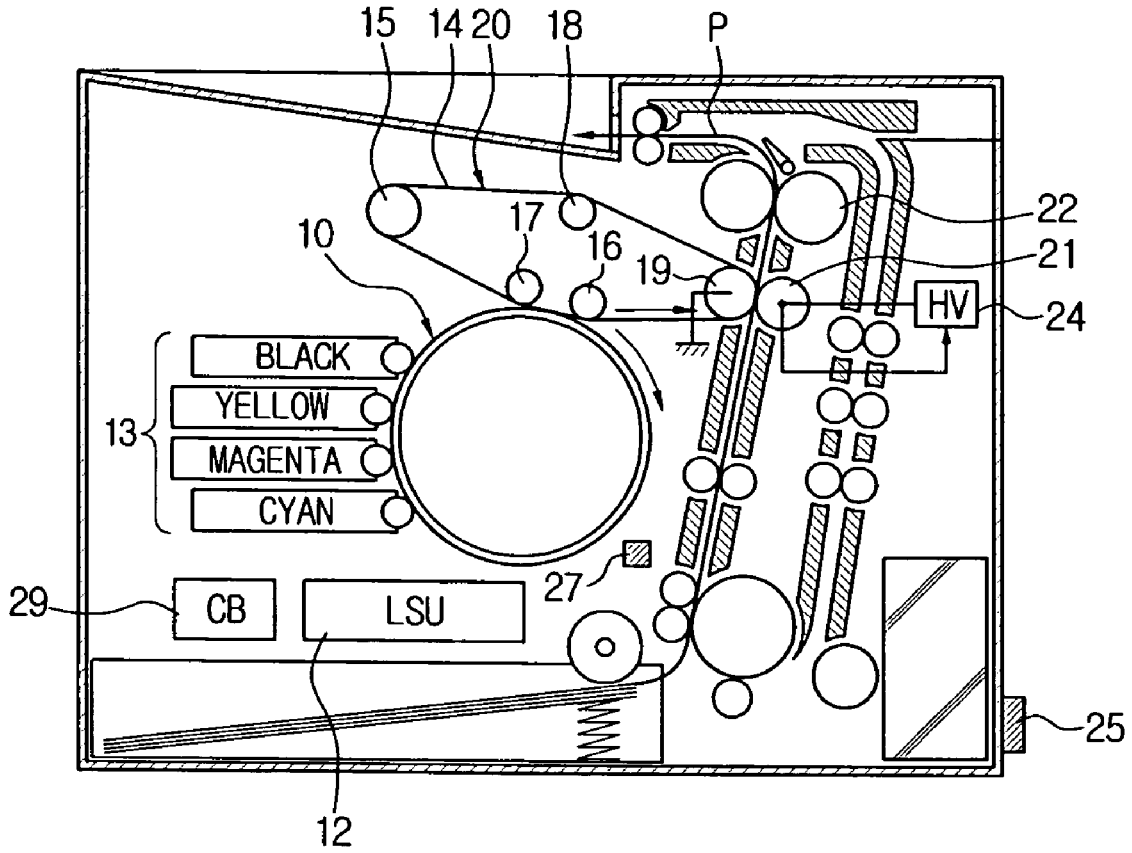
FIG. 2 is a view illustrating an image forming apparatus according to an embodiment of the present general inventive concept.

FIG. 2 is a view illustrating an image forming apparatus according to an embodiment of the present general inventive concept.

Referring to FIG. 2, the image forming apparatus may include a photosensitive drum 10, an optical scanning unit 12, a developing unit 13, a transfer unit 20 having a transfer belt 14, a transfer roller 21, a fuser roller 22, an external temperature sensor 25, an internal temperature sensor 27, and a control box or control unit (CB) 29. Here, since the same constituent elements as those of an image forming apparatus of FIG. 1 have the same function and operation, the same reference numerals are given thereto, and the detailed explanation thereof will be omitted.

The external temperature sensor 25 is installed outside the image forming apparatus and senses an external temperature of the image forming apparatus. The internal temperature sensor 27 is installed inside the image forming apparatus and senses an internal temperature of the image forming apparatus. In an example, the external and internal temperature sensors 25 and 27 can be implemented using a psychrometer.

The CB 29 is connected to the external temperature sensor 25, the internal temperature sensor 27, and a high-voltage terminal 24, and determines a transfer voltage applied to the transfer roller 21 according to the external temperature sensed by the external temperature sensor 25 and the internal temperature sensed by the internal temperature sensor 27. That is, the CB 29 calculates a difference between the external temperature sensed by the external temperature sensor 25 and the internal temperature sensed by the internal temperature sensor 27, compares the calculated temperature difference with a preset value, and determines an amount of the transfer voltage to be applied to the transfer roller 21 according to the result of comparison.

In an example, the image forming apparatus may further include a resistance-measuring sensor (not illustrated) to measure a resistance value of the transfer roller 21 and a resistance value of a printing paper P that passes through the transfer roller 21 (hereinafter referred to as 'recognized resistance values'). In this case, the CB 29 determines the transfer voltage according to both the recognized resistance values measured by the resistance measuring sensor and the calculated temperature difference.

Figure 3:
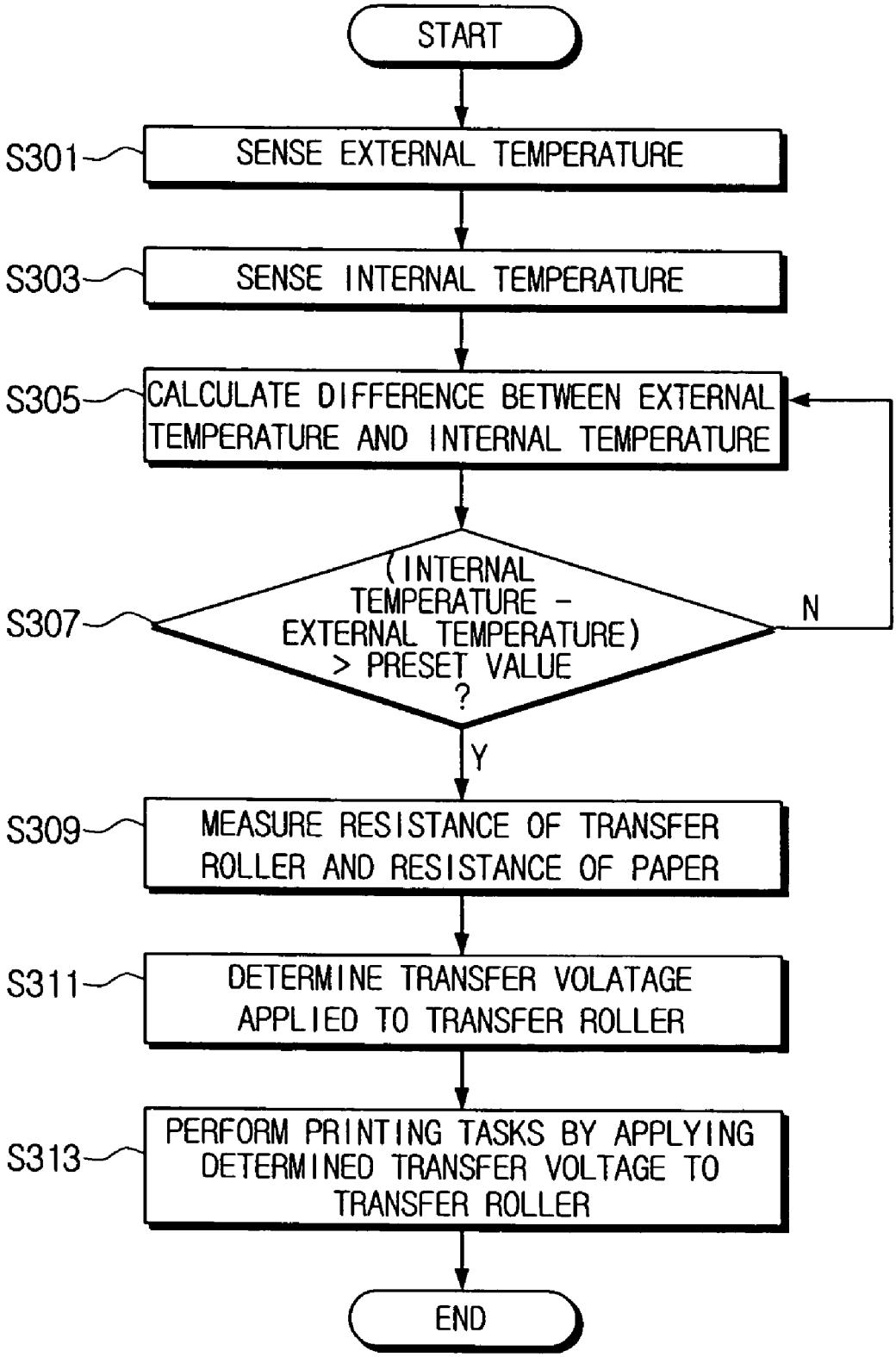
FIG. 3 is a flowchart illustrating a method of controlling a transfer voltage of an image forming apparatus according to another embodiment of the present general inventive concept.

FIG. 3 is a flowchart illustrating a method of controlling a transfer voltage of an image forming apparatus according to another embodiment of the present general inventive concept. Referring to FIGS. 2 and 3, the transfer voltage controlling method of the image forming apparatus will be explained in detail.

A surface of the photosensitive drum 10 is charged with a uniform high voltage by a charge roller (not illustrated). The optical scanning unit 12 forms a latent image on the surface of the photosensitive drum 10 by reflecting light corresponding to an image page to be printed onto the rotating photosensitive drum 10. The latent image formed on the surface of the photosensitive drum 10 by the optical scanning unit 12 is called an electrostatic latent image. In this case, a laser beam driver (not illustrated) receives video data to be printed from a video controller (not illustrated) in the form of a serial data signal, and modulates a laser beam. The modulated laser beam is reflected by a scanning mirror of a rotating polygon mirror and then is scanned around the photosensitive drum 10 to effect a horizontal scanning. Consequently, the laser beam is focused by a focusing lens (not illustrated), is reflected by a rotating hexagon mirror, and then arrives at the surface of the photosensitive drum 10 to form the latent image by the light. The photosensitive drum 10 rotates at a constant speed to effect a vertical scanning of the image page to be printed, and if the laser beam comes to a specified position on the left of the scanning mirror, a line sync signal is generated to effect synchronization of a horizontal scanning so that the image is printed.

The developing unit 13 converts the electrostatic latent image on the surface of the photosensitive drum 10 into a visible toner image using toner particles. The converted visible toner image is transferred to the transfer belt 14 by a photosensitive transfer roller 16.

The transfer belt 14 moves the toner particles attached to the surface of the photosensitive drum 10 by the developing unit 13 to a front surface of the printing paper P. At this time, a back surface of the printing paper P is charged with a positive (+) charge by a corona discharge caused by a positive (+) high voltage (in a range of +5 kV to +7 kV) applied to a transfer wire. Since an electrostatic force generated by the transfer corona discharge is greater than an adhesive power of the toner particles to the photosensitive drum 10, the toner particles that move along the transfer belt 14 are attached to the front surface of the printing paper P that passes through the transfer belt 14 and the transfer roller 21 to form a visible image.

At this time, since the toner image moves to the front surface of the printing paper P by the transfer roller 21 using a weak electrostatic force, it may be scattered due to an external influence. Accordingly, the fuser roller 22 melts and firmly fuses the toner particles to form the visible image on the printing paper P by applying heat (in a range of 150 to 190° C.) and pressure (in a range of 4 to 6 kg) to the printing paper P.

Figure 4A:
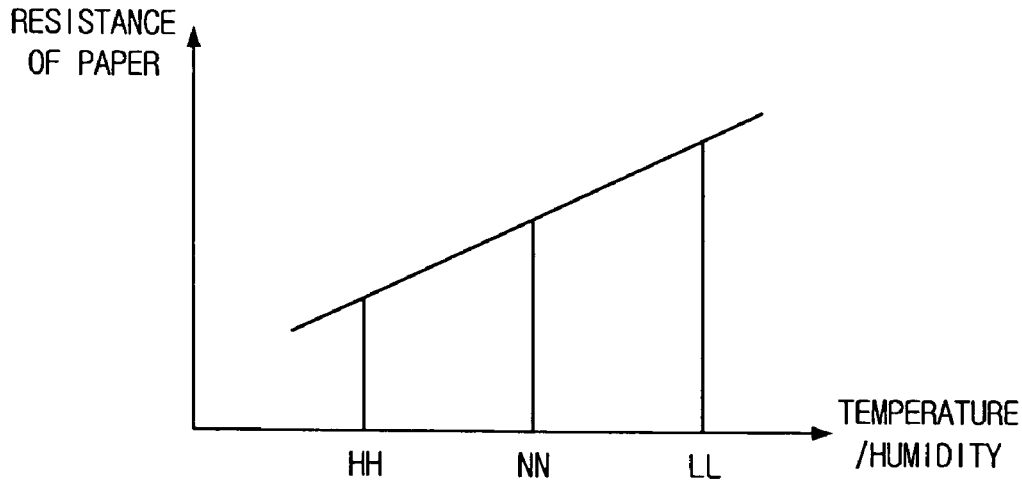
FIG. 4A is a view illustrating a paper resistance according to a change of temperature and humidity.
Figure 4B:
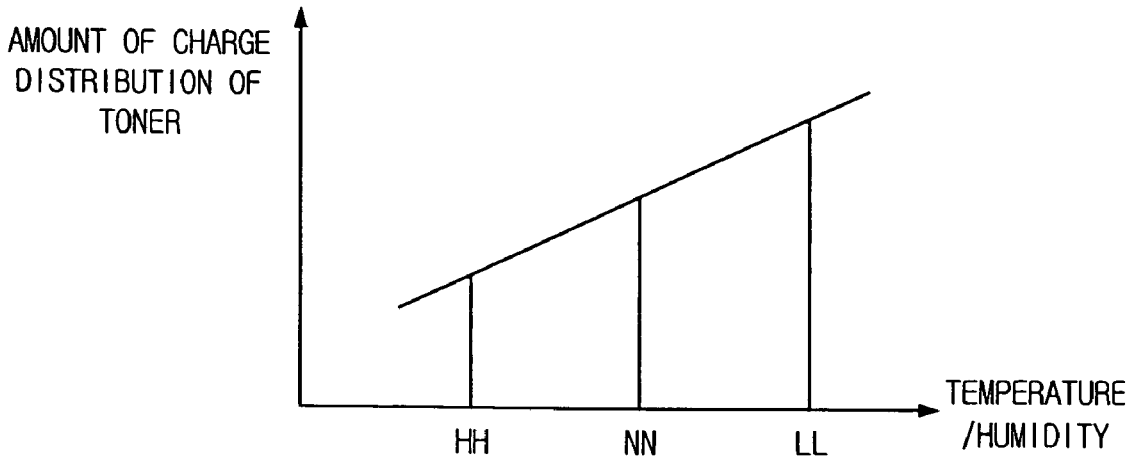
FIG. 4B is a view illustrating an amount of charge distribution of toner according to a change of temperature and humidity.

A resistance of the printing paper P that passes through the photosensitive belt 14 and the transfer roller 21 and an amount of charge distribution of toner attached to photosensitive belt 14 may be changed according to a change of temperature and humidity as shown in FIGS. 4A and 4B. Accordingly, the transfer voltage applied to the transfer roller 21 can be differently adjusted according to the change of the temperature and the humidity.

Meanwhile, the external temperature sensor 25 senses the external temperature of the image forming apparatus (S301). The transfer voltage can be adjusted in correspondence to the recognized resistance voltage that is changed according to an abrupt change of the ambient temperature of the image forming apparatus.

Also, the internal temperature sensor 27 senses the internal temperature of the image forming apparatus (S303). The printing paper P picked up by a feeder is conveyed along a conveyer path and passes through the photosensitive belt 14 and the transfer roller 21. If the printing paper P is successively fed from the feeder, the internal temperature of the image forming apparatus rises due to heat of the image forming apparatus. The internal temperature sensor 27 senses the internal temperature of the image forming apparatus and enables the transfer voltage to be adjusted in correspondence to the change of the recognized resistance values according to the change of the internal temperature of the image forming apparatus.

Figure 5:
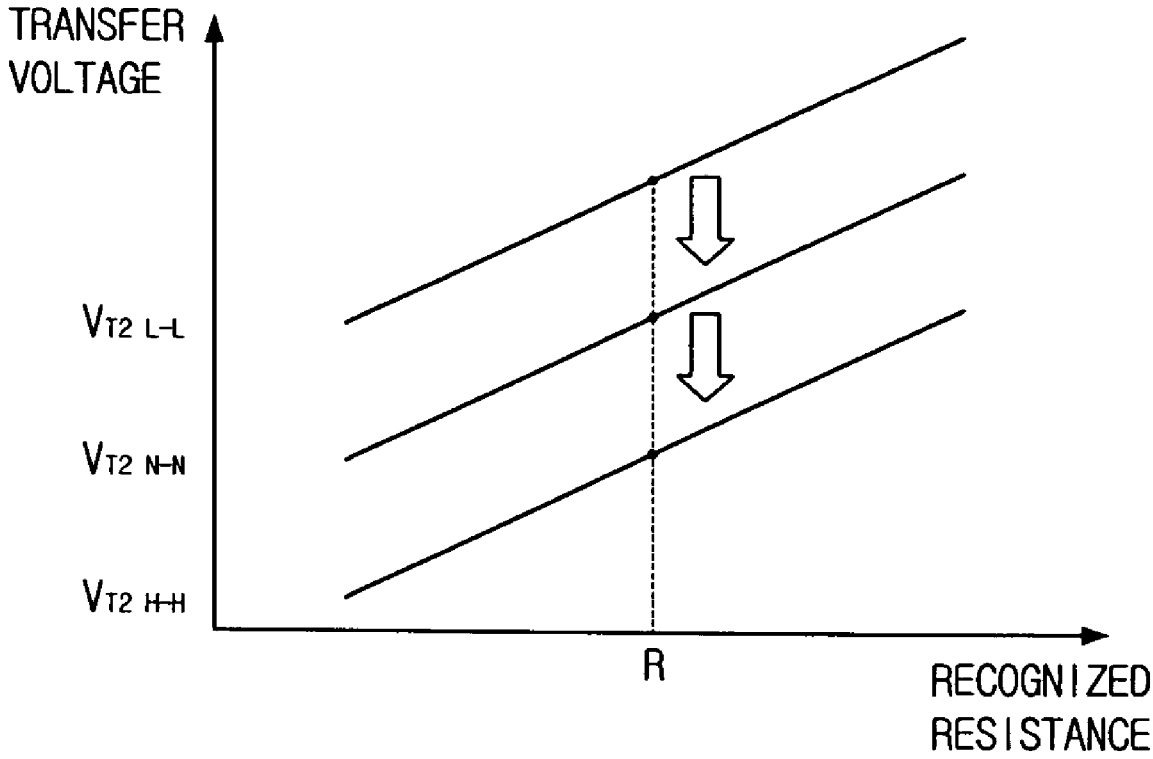
FIG. 5 is a view illustrating an adjustment of a transfer voltage according to a recognized resistance.

The CB 29 calculates the difference between the external temperature sensed by the external temperature sensor 25 and the internal temperature sensed by the internal temperature sensor 27 (S305). Also, the CB 29 compares the temperature difference between the calculated external and internal temperatures with a preset value (S307). At this time, the resistance measuring sensor (not illustrated) measures the recognized resistance values, that is, the paper resistance value and the resistance value of the transfer roller 21 (S309). If the recognized resistance values are measured, as shown in FIG. 5, the CB 29 determines the transfer voltage to be applied to the transfer roller 21 according to the measured recognized resistance values and the calculated temperature difference (S311). For example, if the internal temperature is higher than the external temperature by more than the preset value, the CB 29 reduces the transfer voltage by a predetermined value. An amount of the transfer voltage that is reduced by the CB 29 is shown in FIG. 5. As shown in FIG. 5, the transfer voltage applied to the transfer roller 21 is changed according to the internal temperature and the recognized resistance values, and it may be reduced by the preset value if the applied transfer voltage exceeds a threshold value. Also, the CB 29 may be implemented to reduce the transfer voltage by the predetermined value in a diverse range in accordance with the temperature difference between the internal and external temperatures.

If the transfer voltage to be applied to the transfer roller 21 is determined, the CB 29 controls the high-voltage terminal 24 to apply the determined transfer voltage to the transfer roller 21 and performs printing tasks so that the toner is transferred and fused on the paper by the controlled transfer voltage (S313).

Consequently, the image forming apparatus can adaptively adjust the transfer voltage in correspondence to the overheating of the apparatus due to the successive supply of papers and the abrupt change of the external temperature of the apparatus, thereby improving the printing quality.

As described above, it will be apparent that the method of controlling a transfer voltage of an image forming apparatus according to the present general inventive concept has advantages in that it can improve the printing quality by adaptively adjusting the transfer voltage in correspondence to the overheating of the apparatus due to the successive supply of papers and the abrupt change of the external temperature of the apparatus.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of controlling a transfer voltage of an image forming apparatus, the method comprising:

sensing an external temperature of the image forming apparatus;

sensing an internal temperature of the image forming apparatus;

determining a transfer voltage to be applied to a transfer roller according to the sensed external and internal temperatures; and applying the determined transfer voltage to the transfer roller.

2. The method as claimed in claim 1, wherein the determining of the transfer voltage comprises:

calculating a temperature difference between the sensed external temperature and the sensed internal temperature;

comparing the calculated temperature difference with a preset value; and upon determining that the internal temperature is higher than the external temperature by more than the preset value, reducing the transfer voltage by a predetermined value.

3. The method as claimed in claim 2, further comprising:

measuring a resistance value of the transfer roller and a resistance value of a printing paper that passes through the transfer roller, wherein the determining of the transfer voltage comprises determining the transfer voltage according to the external and internal temperatures, the measured resistance value of the transfer roller, and the measured resistance value of the printing paper.

4. The method as claimed in claim 1, wherein the sensing of the external and internal temperatures comprises sensing the external and internal temperatures using a psychrometer.

5. The method as claimed in claim 1, wherein the determining of the transfer voltage comprises:

measuring a resistance value of the transfer roller; and determining the transfer voltage according to the resistance value and the internal and external temperatures.

6. The method as claimed in claim 1, wherein the determining of the transfer voltage comprises:

measuring a resistance value of a printing paper; and determining the transfer voltage according to the resistance value and the internal and external temperatures.

7. The method as claimed in claim 1, wherein the determining of the transfer voltage comprises:

determining the transfer voltage according to a combination of the internal temperature, the external temperature, an internal humidity, and an external humidity.

8. The method as claimed in claim 1, wherein the sensing of the internal temperature comprises:

sensing a temperature of an area disposed on a paper path of a printing paper as the internal temperature.

9. A method of an image forming apparatus, the method comprising:

determining a transfer voltage according to an internal temperature of the image forming apparatus, an external temperature of the image forming apparatus, and at least one of a resistance of a transfer roller and a resistance of a printing paper; and applying the determining transfer voltage to the transfer roller to transfer an image from a transfer unit to the printing paper.

10. An image forming apparatus comprising:

a transfer roller to transfer a toner image from a transfer unit to a printing paper;

an internal temperature sensor to sense an internal temperature of the image forming apparatus;

an external temperature sensor to sense an external temperature of the image forming apparatus; and a control unit to determine a transfer voltage to be applied to the transfer roller according to the internal temperature and the external temperature.

11. An image forming apparatus comprising:

a transfer roller to transfer an image from a transfer unit to a printing paper;

a sensor unit to sense an internal temperature of the image forming apparatus, an external temperature of the image forming apparatus, and at least one of a resistance value of the transfer roller and a resistance value of the printing paper; and a control unit to determine a transfer voltage to be applied to the transfer roller according to the internal temperature, the external temperature, and the at least one of the resistance values.

12. The image forming apparatus as claimed in claim 11, wherein the sensor unit comprises an internal temperature sensor disposed between a photo sensitive drum and a paper path of the printing paper to sense the internal temperature.

13. The image forming apparatus as claimed in claim 11, wherein the sensor unit comprises an internal temperature sensor disposed adjacent to a paper path of the printing paper to sense the internal temperature.

14. The image forming apparatus as claimed in claim 11, wherein the sensor unit comprises an internal temperature sensor disposed adjacent to a photosensitive drum to sense the internal temperature.

15. The image forming apparatus as claimed in claim 11, wherein the sensor unit comprises an internal temperature sensor to sense the internal temperature and an external temperature sensor to sense the external temperature.

16. The image forming apparatus as claimed in claim 15, wherein the internal temperature sensor is disposed opposite to the external temperature sensor with respect to a paper path of the printing paper.

17. The image forming apparatus as claimed in claim 11, wherein the sensor unit senses an internal humidity and an external humidity, and the control unit determines the transfer voltage according to the internal temperature, the external temperature, and at least one of the resistance value of the transfer unit, the resistance value of the printing paper, the internal humidity, and the external humidity.

18. The image forming apparatus as claimed in claim 11, wherein the sensor unit comprises an internal sensor to sense the internal temperature, and an external sensor to sense the external temperature, and the external sensor is disposed away from the transfer roller than the internal sensor.

19. The image forming apparatus as claimed in claim 11, wherein the control unit generates a temperature difference between the internal and external temperatures and determines the transfer voltage to be applied to the transfer roller according to at least one of the temperature difference and the at least one of the resistance value of the transfer roller and the resistance value of the printing paper.

20. The image forming apparatus as claimed in claim 11, wherein the control unit determines the transfer voltage to be applied to the transfer roller according to at least one of variations of the internal temperature and the external temperature and at least one variation of the resistance value of the transfer roller and the resistance value of the printing paper.

* * * * *